US006699120B1

(12) United States Patent
Darum

(10) Patent No.: US 6,699,120 B1
(45) Date of Patent: Mar. 2, 2004

(54) METHOD AND SYSTEM FOR CONTROLLING VENTILATION

(75) Inventor: Jesper Darum, Brøndby (DK)

(73) Assignee: VKR Holding A/S, Søborg (DK)

( * ) Notice: Subject to any disclaimer, the term of this patent is extended or adjusted under 35 U.S.C. 154(b) by 0 days.

(21) Appl. No.: 10/257,836

(22) PCT Filed: Jun. 23, 2000

(86) PCT No.: PCT/DK00/00338

§ 371 (c)(1),
(2), (4) Date: Oct. 18, 2002

(87) PCT Pub. No.: WO02/01116

PCT Pub. Date: Jan. 3, 2002

(51) Int. Cl.[7] ..... F24F 7/00
(52) U.S. Cl. ..... 454/239; 454/256
(58) Field of Search ..... 454/196, 239, 454/256, 258

(56) References Cited

U.S. PATENT DOCUMENTS 5,226,256 A 7/1993 Fries et al.
5,951,394 A * 9/1999 Pariseau ..... 454/61
5,989,119 A * 11/1999 Raisanen ..... 454/239

FOREIGN PATENT DOCUMENTS

EP 0405149 A2 1/1991

* cited by examiner

*Primary Examiner*—Harold Joyce
(74) *Attorney, Agent, or Firm*—Venable LLP; John P. Shannon; Chad C. Anderson

(57) ABSTRACT

Internal climate comfort in a living room occupied by human users is controlled by natural ventilation, through at least two external adjustable openings and at least one internal opening, said natural ventilation being determined from a constant physical parameter of said living room and measured parameters relating to wind load and temperature difference to approximate a target air exchange rate for the room. An adjustment parameter ($S_1$, $S_2$) for each external opening is determined to provide air exchange ($Q_f$) to the room on the basis of said target air exchange rate and is modified by application of a set of individual comfort functions ($\mu$) for each opening, taking account at least of outside and inside temperature, air exchange and wind speed and direction. The individual comfort functions ($\mu$) of said set are weighed by fuzzy optimization to produce optimized and substantially equally distributed comfort conditions in positions in the living room adjacent each opening.

9 Claims, 5 Drawing Sheets

METHOD AND SYSTEM FOR CONTROLLING VENTILATION

The present invention relates to a computer controlled method of controlling internal climate comfort by natural ventilation in a living room in a building occupied by human users, said room being connected with the outside of the building through at least two external openings with associated passive ventilation devices, which are individually adjustable by means of associated operator units and being further connected through at least one internal opening with another room of the building, whereby a target air exchange rate for said living room is calculated from a constant physical parameter of the room and measured parameters relating to wind load or air pressure and :to difference between indoor and outdoor temperatures.

Computer controlled methods and systems for heating, ventilation and air conditioning in buildings are well known and conventionally based on the use of active heating, ventilation and air humidity control devices. Various designs of such systems are described e.g. in U.S. Pat. No. 4,567,939, U.S. Pat. No. 4,931,948, U.S. Pat. No. 5,215,498, U.S. Pat. No. 5,348,078, U.S. Pat. No. 5,803:,804, DE-A-196 00 694 and EP-A-0 585 133.

It is well-known that such an active indoor climate adjustment does usually not function in the best possible way under variable outdoor climate conditions and furthermore is attended by a considerable energy consumption.

On this background, recent years have shown an increased interest for using controlled natural ventilation for indoor climate adjustment. By controlled natural ventilation is in this connection meant adjustment of the indoor climate in a building by use of natural variation in outdoor and indoor climate variables and by ventilation air supply through adjustable openable parts or sections of building facades. Such openable ventilation devices are typically window sections in the building facades, however, they may also comprise other forms of openable facade parts, such as adjustable ventilation dampers, grids and similar devices.

Experimental projects to illustrate the possibilities of natural indoor climate adjustment by use of intelligent computer systems are described e.g. by J. I. Kindangen in his report "Artificial neural network and naturally ventilated buildings" in Building Research and Information, Vol. 24, no. 4, 1996, and by D. Azzi, G. S. Virk, A. K. M. Azad and D. L. Loveday in a conference paper "Towards the "intelligent building"" at the 18th AIVC Conference in Greece in 1997, whereas control strategies herefor are described by A. J. Martin in "Control of Natural Ventilation", BSRIA Technical Note TN 11/95. The purpose of these experiments has essentially been to describe different parameter models for pure computer controlled adjustment of various forms of adjustable heating, ventilation, shading and humidity control devices.

U.S. Pat. No. 5,226,256 discloses a method of the above type, by which passive ventilation devices in the form of windows can by means of sensors adapted for the purpose be adjusted in dependence of indoor climate variables, such as temperature, relative air humidity and $CO_2$ content and external parameters as for instance noise conditions in the surroundings and the airflow velocity near a window. For this adjustment each window is associated with a microprocessor which can also be controlled from a portable or stationary remote control unit just as all windows can be controlled jointly from a central control unit in a control room.

On the basis of this prior art it is the object of the invention to provide an optimized method for automatic computer controlled ventilation of living rooms in buildings, by which inconveniences, such as the feeling of draught under cold weather conditions, resulting from the supply of fresh air to a living room by the flow of air through external openings such as opened windows can be significantly reduced and an increased and well distributed internal climate comfort can be obtained.

To fulfil this object the method according to the invention is characterized in that an adjustment parameter for the operator unit of each of said passive ventilation devices is determined to provide an air exchange to the room on the basis of said target air exchange rate, said adjustment parameters being further modified by application of a set of comfort functions, which are established individually for each of said external and internal openings, said comfort functions being determined to take account at least of outside and inside temperature, air exchange and wind load or air pressure and the comfort functions of said set being weighed by fuzzy optimization to produce optimized and substantially equally distributed comfort conditions in positions in the living room adjacent each of said openings.

Whereas some principles of general application of fuzzy logic operations to building climate control have been described in a publication by the Frauenhofer Institute for Information and Data Processing IITB TH. Bernard and H.-B. Kunze "Multi-objective Optimization of Building Climate Control Systems using Fuzzy-logic", the invention is based on the recognition of the fact that no universal model can be realistically applied to describe human comfort perception, but that normalized performance criteria can de described as fuzzy membership functions, which can be optimized by the use of fuzzy optimization Preferred ways of implementation of the method are stated in dependent claims 2 to 6.

According to the invention the method is carried out by means of a computer controlled system for natural ventilation in a living room in a building occupied by human users, said room being connected with the outside of the building through at least two external openings with associated passive ventilation devices, which are individually adjustable by means of associated operator units and being further connected through at least one internal opening with another room of the building, said natural ventilation being determined from a constant physical parameter of said living room and measured parameters relating to wind load or air pressure and difference between indoor and outdoor temperatures to approximate a target air exchange rate for said living room, said system being characterized by comprising a computer device and sensor means for sensing said wind load or air pressure and said temperature parameters and inputting corresponding wind and temperature data to said computer device, said computer device having means for storing a target air exchange rate for said living room, means for determination of an adjustment parameter for the operator units of each of said passive ventilation devices to provide an air exchange to the room on the basis of said target air exchange rate, means for establishing a set of comfort functions individually for each of said external and internal openings to take account at least of outside and inside temperature, air exchange and wind load or air pressure, and means for modification of said adjustment factors by application of said set of comfort functions weighed by fuzzy optimization to produce optimized and substantially equally distributed comfort conditions in positions in the living room adjacent each of said openings.

Preferred embodiments of the system according to the invention are stated in dependent claims 8 to 11.

In the following the invention will be further explained with reference to the accompanying schematical drawings, in which FIG. 1 is a schematical sectional view of a living room in a building having two external openings in the form of openable windows and being connected with another room in the building through an internal opening in the form of a door;

Figure 1:
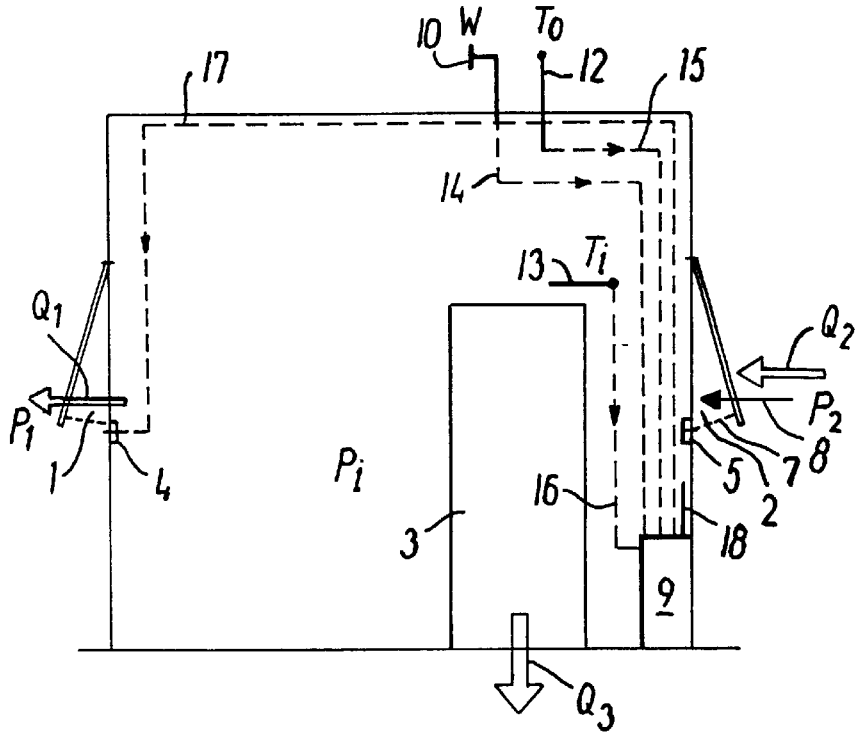

FIG. 1 is a simplified vertical sectional view of a living room in a building having two external openings in the form of openable windows 1 and 2 and an internal opening in the form of a door 3. Each of windows 1 and 2 is shown as a top hung window having a sash structure which from a fully closed position can be opened to any position within a range of ventilation positions by automatic control. As schematically illustrated windows 1 and 2 are provided with operator units 4 and 5, e.g. in the form of chain operators having a drive unit, arranged e.g. at a bottom member of the main frame structure, comprising an electric motor and engaging an elongate chain 6 and 7, respectively, the free end of which is connected with the bottom member of the sash structure in a manner not illustrated in detail.

To each of operators 4 and 5 an adjustment parameter defining the size of the ventilation opening of window 1 and 2, respectively, may be supplied from a central control unit in the form of a computer 9. Since in the illustrated example the size of the ventilation opening is unambiguously defined by the adjusted length of chains 6 and 7, respectively, the variable adjustment parameter for each window may be defined as the length s of the chain, which is determined by the number of increment steps of a chain wheel engaging the respective chain.

In the situation illustrated in FIG. 1 a wind load is acting in a direction shown by arrow 8 substantially at right angles to the building facade in which the window 2 is arranged. With both of windows 1 and 2 as well as door 3 in open positions air flows $Q_1$, $Q_2$ and $Q_3$ will be directed through each of openings 1, 2 and 3, of which air flow $Q_2$ is directed from the outside into the living room,; whereas air flows $Q_1$ and $Q_3$ are directed outwards from the room.

For the conduct of the ventilation method of the invention air flows $Q_1$, $Q_2$ and $Q_3$ are further determined by the difference between the outside air pressure $P_1$ and $P_2$ in front of each of external window openings 1 and 2, respectively, and the inside pressure in the room $P_i$. The outside pressure in front of each window is determined by the wind load and a window constant dependent on the architecture and the location of the window with respect to the wind direction. Wind load and direction is measured by a wind sensor 10, where-as outside and inside temperatures $T_o$ and $T_i$, respectively, are measured by temperature sensors 12 and 13. From each of sensors 10, 12 and 13 input data are supplied via lines 14, 15 and 16 to central control unit 9, which via output lines 17 and 18 supplies output data to operator units 4 and 5, respectively, for variable opening of windows 1 and 2 within their ranges of ventilating positions by adjustment of the respective chain lengths $s_1$ and $s_2$ of chains 6 and 7, respectively. As an alternative to wind sensor 10 measurement of outside and inside air pressure could be effected directly by pressure sensing by means of suitable pressure sensors.

Since as mentioned above the air flows $Q_1$, $Q_2$ and $Q_3$ through openings 1, 2 and 3 may have either of two opposite directions, i.e. from the outside into the room and vice versa, the flow direction will be indicated in the calculations developed in the following by application to the numerical value of the corresponding volumetric flow rate of a positive sign for the direction outside-in and a negative sign for the direction inside-out.

For a satisfactory ventilation and internal climate comfort in the living room a target air exchange rate is determined and expressed as the volumetric flow rate of the fresh air supply needed to effect a predetermined number of total air exchanges pr. time unit.

For the air flows $Q_1$, $Q_2$ and $Q_3$ the following basic continuity condition will apply to indicate that the amount of air flowing into the room should be equal to the amount discharged from the room $$Q_1+Q_2+Q_3=0 \tag{1}$$

On an empirical basis the actual fresh air supply $Q_f$ to the room will be related to the numerical volumetric rates of air flows $Q_1$, $Q_2$ and $Q_3$ through openings 1, 2 and 3 as follows $$Q_f=(|Q_1|+|Q_2|+|Q_3|)/2 \tag{2}$$

It will easily be appreciated that the air supply $Q_f$ can be obtained during the opening periods for windows 1 and 2 by a multiplicity of different combinations of the opening or flow areas of the two windows. For a top hung chain-operated window as illustrated in FIG. 1 the opening area A will be $$A=s(2*h/2+w), \tag{3}$$

where s is the active length of the operator chain and h and w are the height and width, respectively, of the air flow area.

Since the only variable parameter in this expression is the chain length s the expression could be simplified into $$A=C_a*s, \tag{4}$$

where $C_a$ is a constant for the window opening area.

Figure 2:
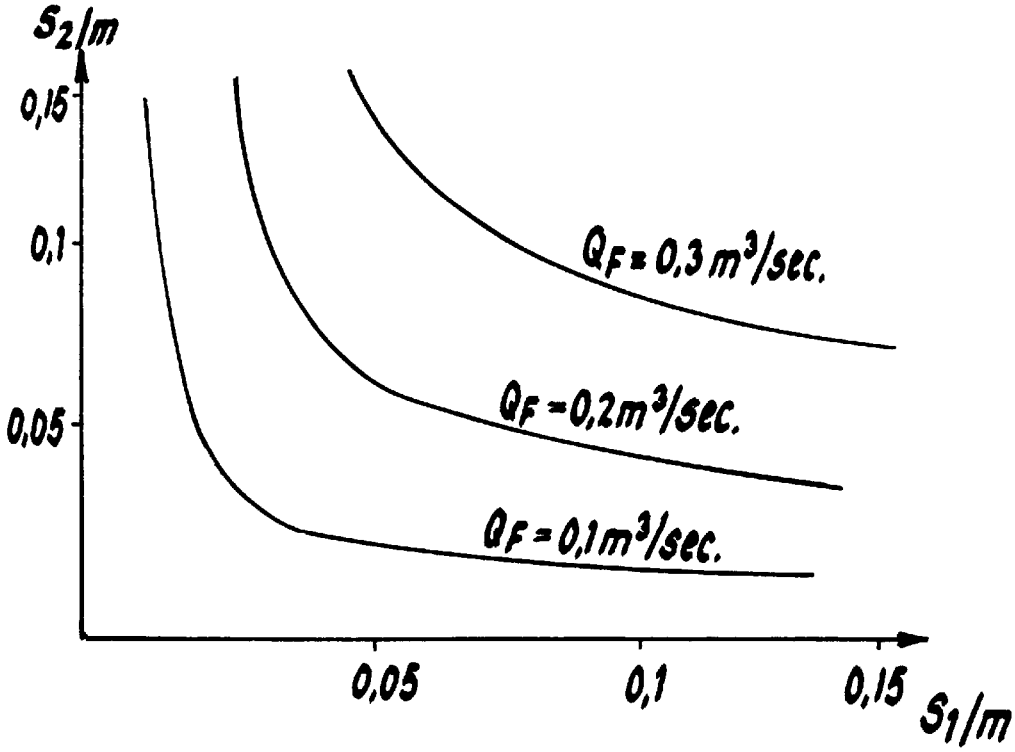
FIG. 2 is a graphic representation of the relationship between adjustment parameters for the two windows shown in FIG. 1 at predetermined air exchange rates.

In FIG. 2 a graphic representation is shown illustrating how various defined target values of the actual air supply $Q_f$ could be accomplished by combination of various opening areas of windows 1 and 2 in FIG. 1 defined by the respective chain lengths $s_1$ and $s_2$.

For each of windows 1 and 2 the flow rate $Q_n$ will be determined by $$Q_n=C_{dn}*C_{an}*s_n*(2(P_n-P_i)/\rho)^{+e,fra\ 1/2}+ee\ , \tag{5}$$

where $C_{dn}$ is a window constant for window n dependent on the shape of the window and the design of main frame and sash profiles, whereas $P_n$ is the outside pressure, e.g. caused by wind load, in front of the window and ρ is the air density, which is temperature dependent. As can be seen this expression can be simplified into $$Q_n = C_{wn} * s_n * (2(P_n - P_i)/\rho)^{+e,fra\ 1/2} + ee\ , \quad (6)$$

where $C_{wn}$ is simply a window constant.

In the expressions (5) and (6) the outside pressure in front of a window is determined by $$P_n = 0.5 * C_p * \rho * v^2 \quad (7)$$

where $C_p$ is a window constant depending on the architecture of the building and the location of the window with respect to the wind direction, whereas v is the wind speed.

By the method of the invention the ventilation and internal climate comfort of a living room, e.g. as shown in FIG. 1, is controlled by control of an adjustment parameter of a passive ventilation device associated with each of the external openings of the room. In the example in FIG. 1 the external openings are windows and the passive ventilation devices comprise the openable wings or sash structures of such windows in combination with operator units, by which the sash structure can be moved between a fully closed position and any ventilation position within a range of such positions. In the illustrated example, where the operator units are well known chain operators the range of ventilation positions will be limited by a maximum open position corresponding to the maximum free length of the chain connecting the sash structure with the electric operator drive mechanism arranged on the main frame structure.

The aim of the method of the invention is to provide a ventilation with an optimized internal climate comfort by adjustment of the same adjustment parameter for the operator unit of each of a number of windows in such a way that, while maintaining ventilation at a level sufficient to approximate the target air exchange rate, substantially equally distributed comfort conditions are produced in positions in the living room adjacent each of the openings, whereby account is taken also of an internal opening such as a door connecting the living room with another room in the building.

Figure 3:
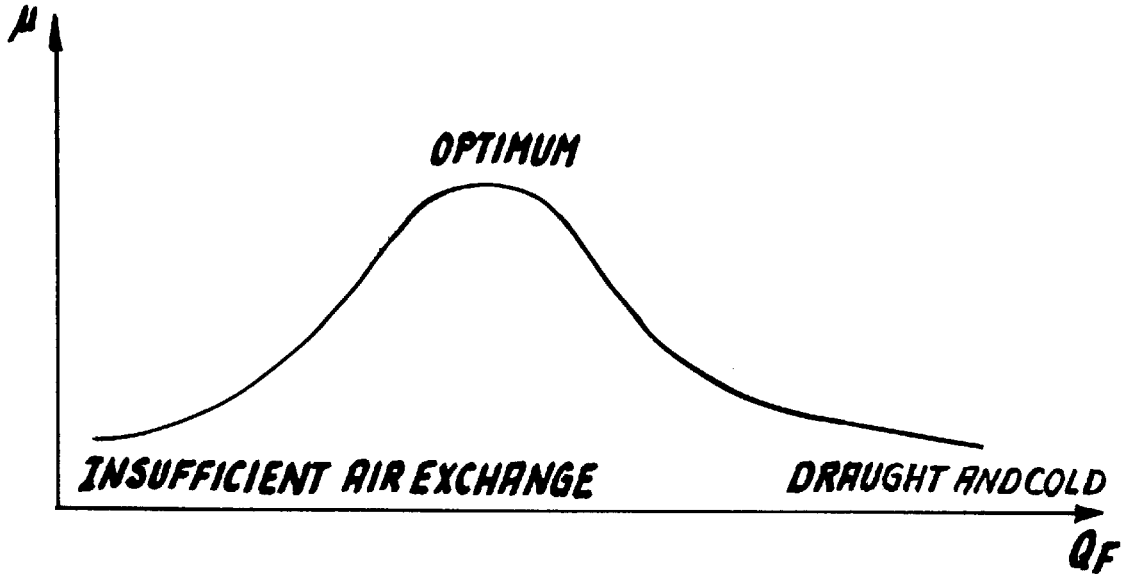
FIG. 3 is an idealized graphic representation of user comfort as a function as a function of air exchange to a living room.

As illustrated in the idealized graphical representation in FIG. 3 of climate comfort as a function of the actual supply of fresh air into a living room the comfort perception applied in the method according to the invention is based on the approach that between lower and higher ranges of the air supply rate $Q_f$, in which the comfort level $\mu$ is perceived as unpleasant due to insufficient air exchange, on one hand, and to draught and cold problems, on the other hand, there is an optimum air supply rate, at which the comfort level is perceived as optimum. By application of this approach to positions in the room adjacent each opening in the room corresponding optimized ventilation positions of the passive ventilation devices associated with the external openings of the room such as optimized open window positions can be determined.

Figure 4:
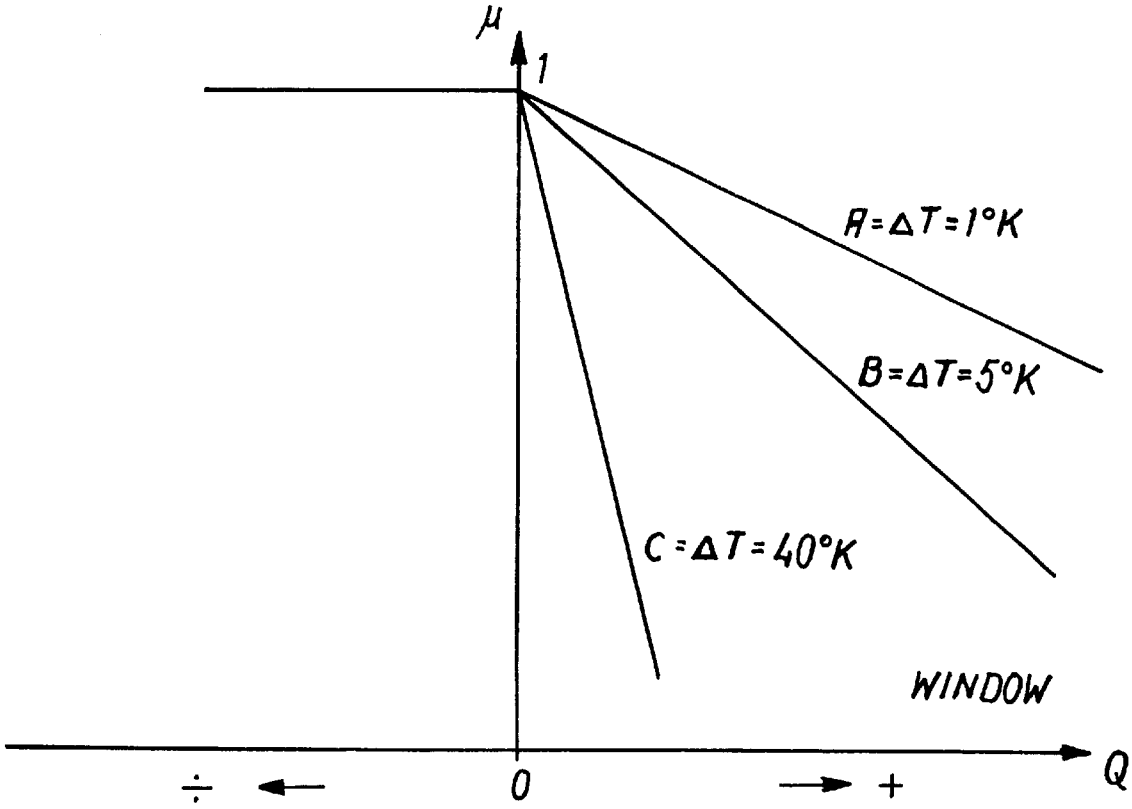
FIGS. 4, 5 and 6 are graphic representations of comfort functions for an openable window, an internal opening and air exchange, each showing perceived comfort level as a function of relative air flow.
Figure 5:
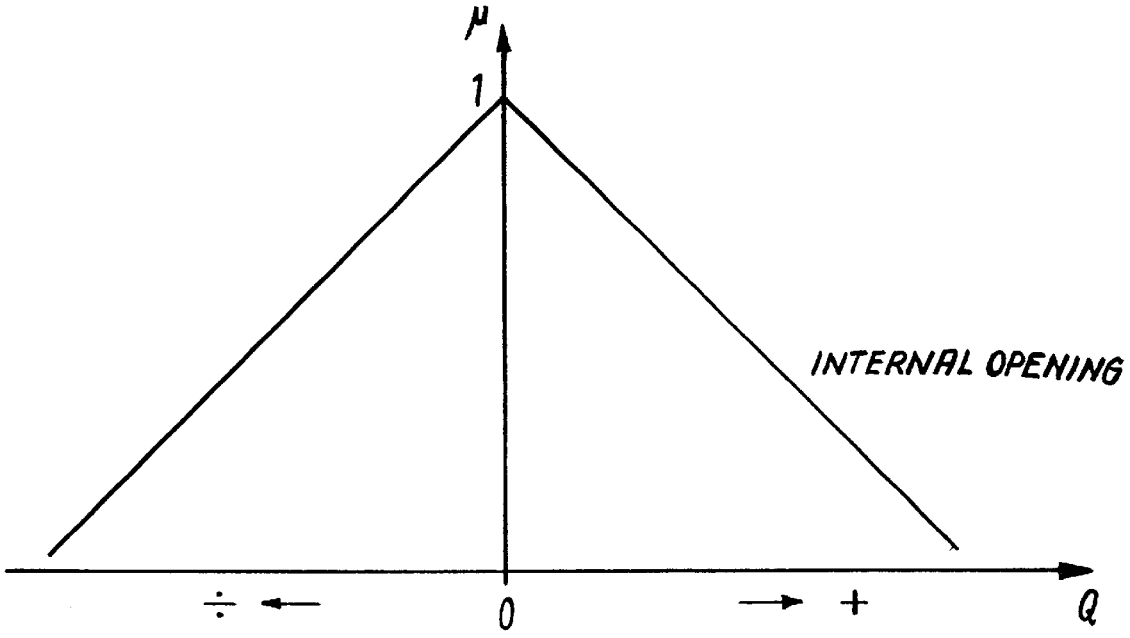

In FIGS. 4 and 5 schematic graphic representations are shown of examples of separate comfort functions for an openable window, such as windows 1 and 2 in FIG. 1, and an internal opening such as door 3 in FIG. 1. In both figures the curves represent perceived level of comfort $\mu$ as a function of the flow Q through the opening with the flow direction outside-in represented by positive flow rate values and the flow direction inside-out by negative values.

In FIG. 4 three curves are shown to illustrate the effect on the perceived comfort level of variations in the temperature difference $\Delta T$ between outside and inside temperature, curves A, B and C representing temperature differences of 1°, 5° and 40°, respectively. Whereas for a relatively low temperature difference the comfort level $\mu$ decreases only relatively slowly with increasing flow rate for the direction outside-in, a significantly more rapid comfort reduction occurs at a larger temperature difference.

In the somewhat idealized representation in FIG. 4 it is assumed that the comfort level will be substantially unaffected by the flow rate for the direction inside-out due to the fact that the temperature of the flow will substantially the same as the indoor temperature $T_i$.

As seen in FIG. 5 the comfort level for an internal opening such as a door can, for practical purposes, be assumed to be symmetrical in the sense that comfort reduction as a function of flow rate will normally not vary from one flow direction to the other, provided the temperature is substantially the same at both sides of the internal opening.

Figure 6:
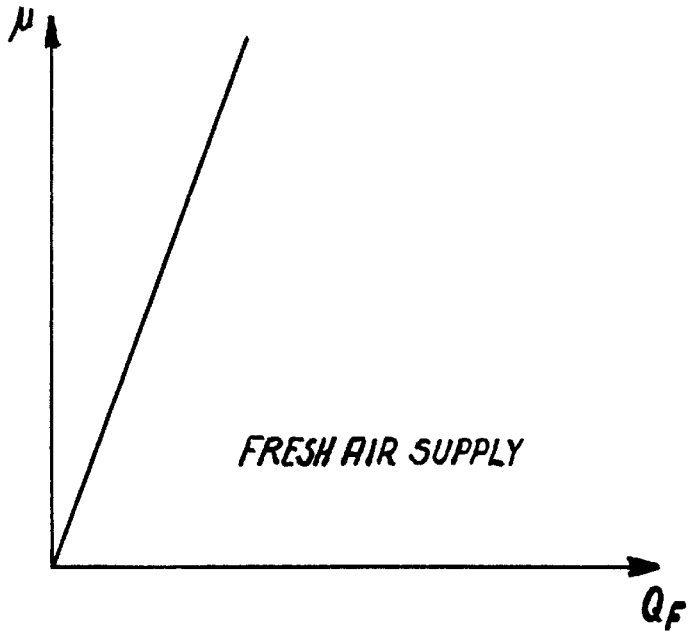

FIG. 6 illustrates the perceived level of comfort as a linear function with positive inclination of the actual net air supply $Q_f$.

Whereas in the separate comfort functions illustrated in FIGS. 4 to 6 the comfort level next to an external or internal opening is shown as a function of the flow through that particular opening, it is essential for the method of the invention that the set of comfort functions as shown e.g. in FIGS. 4 to 6 are compared and weighed against each other to provide a basis for adjustment of the adjustment parameter of each of the passive ventilation devices. The fuzzy optimization used in the method according to the invention requires the comfort functions $\mu_1$, $\mu_2$ and $\mu_3$ for openings 1, 2 and 3 to be expressed as functions of a common variable and be entered into a common coordinate system.

According to the invention a convenient and preferred approach to this problem is to have all the comfort functions determined as functions of the adjustment parameters for the operator units of the passive ventilation devices, e.g. in the described embodiment the chain lengths $s_1$ and $s_2$ of the operator units of windows 1 and 2, respectively.

Figure 7:
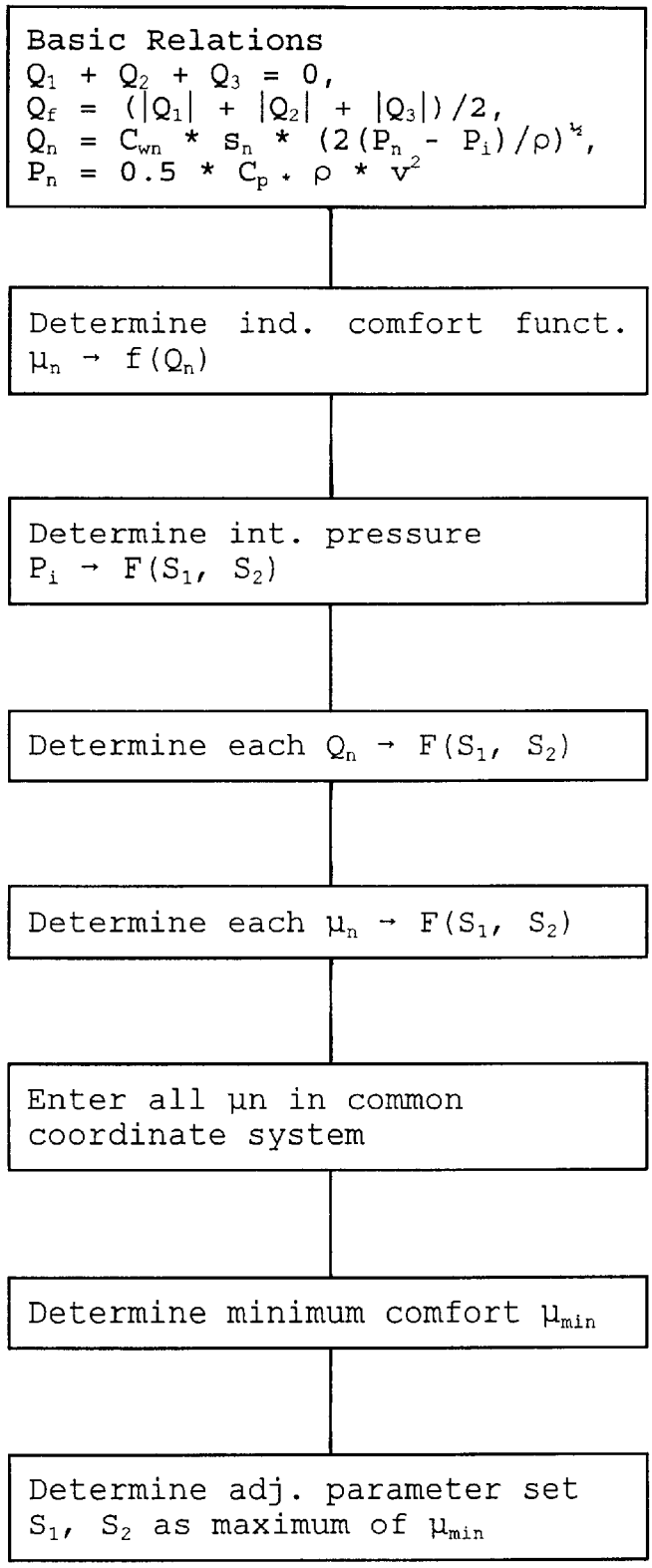
FIG. 7 is a flow diagram of a preferred implementation of the method according to the invention.
Figure 8:
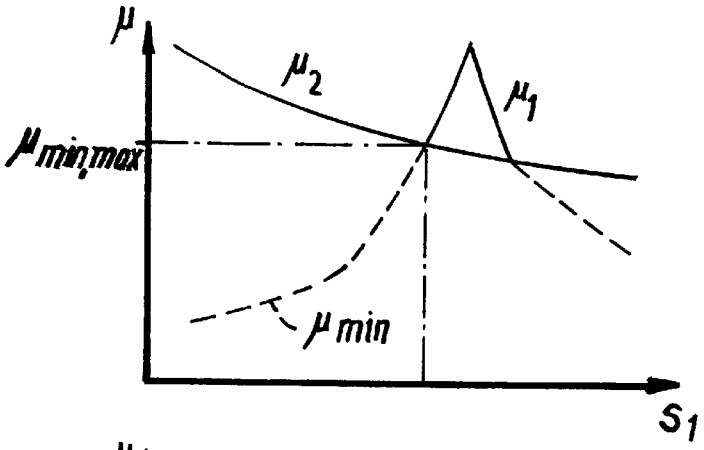
FIGS. 8 to 11 are graphic representations of sets of comfort functions weighed by fuzzy optimization and illustrating variations in dependence on difference between outside and inside temperature and air exchange.
Figure 9:
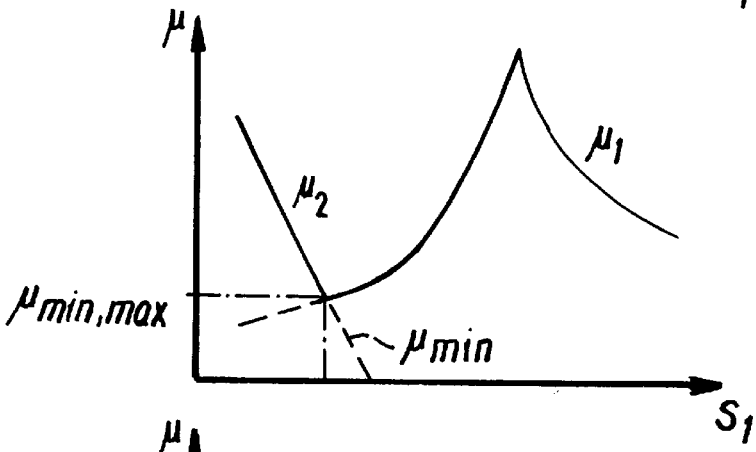
Figure 10:
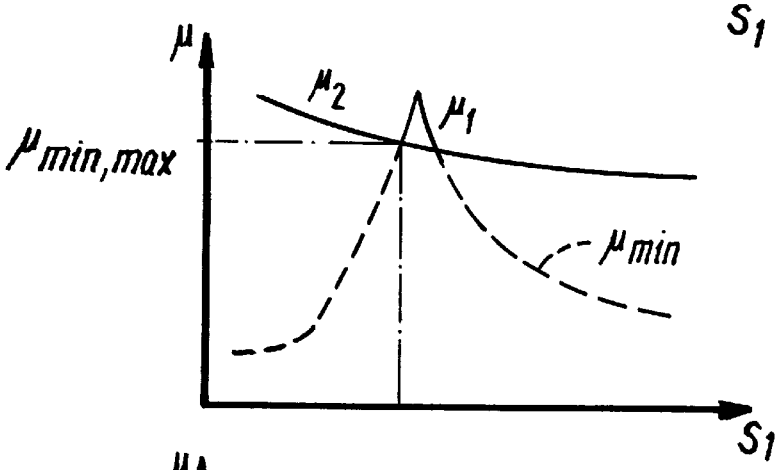
Figure 11:
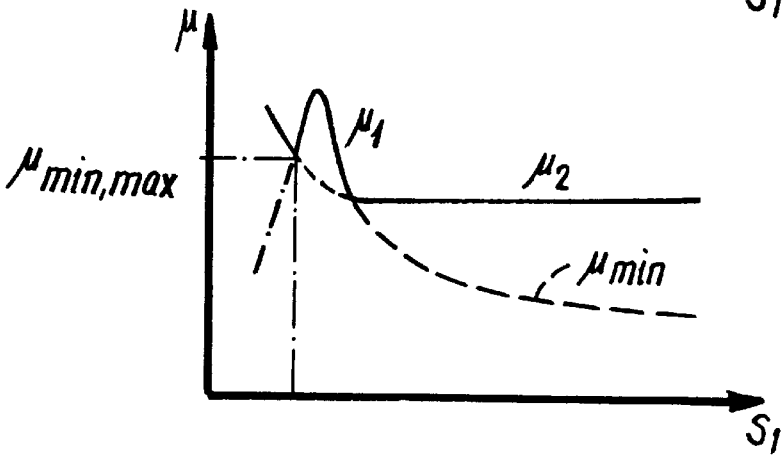

According to a preferred embodiment of the method according to the invention a practical way to implement this approach involves, as illustrated in the flow diagram in FIG. 7, determination of the internal room pressure $P_1$ expressed as a function of the chain lengths $s_1$ and $s_2$ of the operator units of windows 1 and 2 at a given net air supply $Q_f$ as provided by equations (1), (2), (6) and (7) above, followed by determination of the flow rates through openings 1, 2 and 3 as functions of the chain lengths $s_1$ and $s_2$ at the given net air supply $Q_f$.

Following the determination of flow rates through the external and internal openings the combination of chain lengths $s_1$ and $s_2$ can be substituted for the individual air flows $Q_1$, $Q_2$ etc. in the comfort level representations shown in FIGS. 4 to 6. As will be seen, with this representation the comfort curve will take the form of a spatial surface in an orthogonal spatial coordinate system having $s_1$, $s_2$ and $\mu$ as axes and thereby all of the individual comfort functions $\mu_1$, $\mu_2$ etc. can be represented as a landscape of intersecting spatial surfaces in the same spatial coordinate system.

For purposes of illustration, the comfort functions $\mu_1$, $\mu_2$ etc. for all openings and the air supply $Q_f$ are presented in the examples illustrated by the graphic representations in FIGS. 8 to 11 as functions of a single variable, i.e. the chain length $s_1$ Of window 1 in FIG. 1.

In the idealized examples in these figures the flow through the internal opening in the form of door 3 has further been disregarded.

Once the comfort functions $\mu$ are depicted as functions of the same variable the fuzzy optimization implies that the minimum curve of the set of comfort curves is determined. For each set of values of the adjustment parameter the minimum is represented by the spatial curve providing the lowest comfort level.

The optimized adjustment of the common variable for the set of comfort curves, i.e. in FIGS. 8 to 11 the chain length $s_1$ is then determined by well-known fuzzy optimization as the maximum value on the minimum curve. Once the optimized value of the chain length $s_1$ has been determined in this way the value of the chain length $s_2$ needed to obtain a given net air supply $Q_f$ can be determined from the relationship illustrated in FIG. 2.

In each of FIGS. 8 to 11 the curves $\mu_1$ and $\mu_2$ represent the flow directions inside-out and outside-in as shown for windows 1 and 2 in FIG. 1, and the figures illustrates, like FIG. 4, the effect on the perceived comfort level of varying difference ΔT between outside and inside temperatures.

In case of a relatively moderate value of the temperature difference ΔT the method of the invention can be practised in a continuous cooling mode, in which both of windows assume open position, while the adjustment of the chain lengths take account primarily of variations in wind load, i.e. wind speed and/or wind direction.

With larger temperature difference it is preferred however to practise the method of the invention in an intermittent or pulse mode, by which windows 1 and 2 are intermittently opened and reclosed between the fully closed positions, and open positions as defined by the chain lengths determined by the fuzzy optimization.

Within the scope of the invention other kinds of separate comfort functions may be established and take into account for control of the internal climate comfort such as comfort functions relating specifically to inside temperature, $CO_2$— content and humidity, optionally involving the use of separate $CO_2$ and humidity sensing means.

What is claimed is:

1. A computer controlled method of controlling internal climate comfort by natural ventilation in a living room in a building occupied by human users, said room being connected with the outside of the building through at least two external openings (1,2) with associated passive ventilation devices, which are individually adjustable by means of associated operator units (4,5) and being further connected through at least one internal opening (3) with another room of the building, said natural ventilation being determined from a constant physical parameter of said living room and measured parameters relating to wind load or air pressure and to difference (ΔT) between indoor and outdoor temperatures ($T_I$,$T_o$) to approximate a target air exchange rate for said living room, characterized in that an adjustment parameter ($S_1$,$S_2$) for the operator unit (4,5) of each of said passive ventilation devices is determined to provide an air exchange ($Q_f$) to the room on the basis of said target air exchange rate, said adjustment parameters being further modified by application of a set of comfort functions ($\mu$), which are established individually for each of said external and internal openings (1,2,3), said comfort functions ($\mu$) being determined to take account at least of outside and inside temperature ($T_I$,$T_o$), air exchange ($Q_f$) and wind load or air pressure and direction and the comfort functions of said set being weighed by fuzzy optimization to produce optimized and substantially equally distributed comfort conditions in positions in the living room adjacent each of said openings.

2. A method as claimed, in claim 1, characterized in that all comfort functions ($\mu$) of said set are determined as functions of said adjustment parameters ($S_1$,$S_2$) for the operator units (4,5) of said passive ventilation devices and are compared by said fuzzy optimization to provide a minimum comfort function, that a target value of the adjustment parameters ($S_1$,$S_2$) for said passive ventilation devices is determined as a maximum value of said minimum comfort function, whereby a set of adjustment parameters ($S_1$,$S_2$) is determined to provide said optimized substantially equally distributed comfort conditions while maintaining the approximation to said target air exchange rate.

3. A method as claimed in claim 2, characterized in that the flow through each of said external and internal openings are determined by the expressions $$Q_1+Q_2+Q_3=0,$$

$$Q_f=(|Q_1|+|Q_2|+|Q_3|)/2,$$

$$Q_n=C_{wn}*s_n*(2(P_n-P_i)/\rho)^{+e,fra\ 1/2}+ee\text{ , and}$$

$$P_n=0.5*C_p*\rho*v^2,$$

where $Q_1$, $Q_2$ . . . $Q_n$ are the air flows through each of said external and internal openings, $C_{wn}$ is a constant relating to a specific opening, $P_n$ is the outside air pressure in front of a specific opening, $P_i$ the internal air pressure in said room, ρ is air density, $C_p$ is a window constant and v is the wind speed, followed by determination of said comfort functions $\mu$ as separate function of the flow ($Q_1$, $Q_2$ . . . ) through each of said external and internal openings (1,2,3), and determination of said internal pressure $P_1$, the flow through ($Q_1$, $Q_2$ . . . ) each opening and the perceived comfort level ($\mu$) as functions of said adjustment parameters ($S_1$, $S_2$) and entering the resulting comfort function in a common coordinate system before conducting said fuzzy optimization.

4. A method as claimed in claim 1, characterized in that said set of adjustment parameters ($S_1$, $S_2$) is determined in a continuous cooling mode to control said operator units (4, 5) to adjust said passive ventilation devices within a range of ventilation positions.

5. A method as claimed in claim 1, characterized in that said set of adjustment parameters ($S_1$, $S_2$) is determined in a pulse mode for intermittent short term operation of said operator units (4, 5) to open and reclose said passive ventilation devices between a closed position and any position within a range of ventilation positions.

6. A computer controlled system for carrying out a method as claimed in claim 1, by natural ventilation in a living room in a building occupied by human users, said room being connected with the outside of the building through at least two external openings (1, 2) with associated passive ventilation devices, which are individually adjustable by means of associated operator units (4, 5) and being further connected through at least one internal opening (3) with another room of the building, said natural ventilation being determined from a constant physical parameter of said living room and measured parameters relating to wind load or air pressure and difference (ΔT) between indoor and outdoor temperatures ($T_I$, $T_O$) to approximate a target air exchange rate for said living room, characterized by comprising a computer device (9) and sensor means (10, 12, 13) for sensing said wind load or air pressure and said temperature parameters and inputting corresponding wind and temperature data to said computer device (9), said computer device (9) having means for storing a target air exchange rate for said living room, means for determination of an adjustment parameter ($S_1$, $S_2$) for the operator units of each of said passive ventilation devices to provide an air exchange ($Q_f$) to the room on the basis of said target air exchange rate, means for establishing a set of comfort functions ($\mu$) individually for each of said external and internal openings to take account at least of outside and inside temperature ($T_I$, $T_O$), air exchange and wind load or air pressure, and means for modification of said adjustment factors ($S_1$, $S_2$) by application of said set of comfort functions weighed by fuzzy optimization to produce optimized and substantially equally distributed comfort conditions in positions in the living room adjacent each of said openings.

7. A system as claimed in claim 6, characterized by comprising means for shifting the operation of said computer device between said cooling mode and said pulse mode of operation.

8. A system as claimed in claim 6, characterized in that said means for establishing said individual comfort functions and said means for modification of said adjustment factors comprises means for carrying out fuzzy logic computing operations.

9. A system as claimed in claim 6, wherein said external openings (1, 2) are windows having a sash structure, which is openable with respect to a stationary main frame structure within a range of ventilation positions between closed and fully open positions, and said associated operator units comprises a window operator unit for each of said windows, characterized in that each of said operator units (4, 5) comprises a chain operator with an operator housing connected with an element of one of said sash and main frame structures and comprising a drive unit and an elongate chain (6, 7) operable by said drive unit and connected at a free end with an element of the other of said sash and main frame structures to provide a chain length between said elements, which is variable to adjust said sash structure between a fully closed position and any position within a range of ventilation positions, whereby said adjustment parameter ($S_1$, $S_2$) is constituted by said variable chain length.

* * * * *